US010739118B2

(12) United States Patent
Oberholster

(10) Patent No.: US 10,739,118 B2
(45) Date of Patent: Aug. 11, 2020

(54) LONG RANGE BULLET

(71) Applicant: PEREGRINE BULLETS (PTY) LTD, Rietfontein, Pretoria (ZA)

(72) Inventor: Alliwyn Johannes Oberholster, Pretoria (ZA)

(73) Assignee: PEREGRINE BULLETS (PTY) LTD, Rietfontein, Pretoria (ZA)

( * ) Notice: Subject to any disclaimer, the term of this patent is extended or adjusted under 35 U.S.C. 154(b) by 0 days.

(21) Appl. No.: 15/321,653

(22) PCT Filed: Jun. 24, 2015

(86) PCT No.: PCT/ZA2015/000046

§ 371 (c)(1),
(2) Date: Dec. 22, 2016

(87) PCT Pub. No.: WO2015/200934

PCT Pub. Date: Dec. 30, 2015

(65) Prior Publication Data

US 2017/0138709 A1 May 18, 2017

(30) Foreign Application Priority Data

Jun. 24, 2014 (ZA) ..... 2014/04618

(51) Int. Cl.
*F42B 10/42* (2006.01)
*F42B 10/44* (2006.01)
(Continued)

(52) U.S. Cl.
CPC ..... *F42B 10/42* (2013.01); *F42B 10/44* (2013.01); *F42B 14/00* (2013.01); *F42B 14/02* (2013.01); *F42B 33/00* (2013.01)

(58) Field of Classification Search
CPC ..... F42B 14/00; F42B 14/02; F42B 10/42; F42B 10/44; F42B 30/02; F42B 33/00
(Continued)

(56) References Cited

U.S. PATENT DOCUMENTS 711,209 A * 10/1902 Hill ..... F42B 14/02 102/517
802,301 A * 10/1905 Michele ..... F42B 5/02 102/430
(Continued)

FOREIGN PATENT DOCUMENTS

DE 20 2004 015 192 U1 1/2005
DE 10 2004 032 114 A1 1/2006
(Continued)

OTHER PUBLICATIONS

International Search Report and Written Opinion of the International Searching Authority for corresponding International Patent Application No. PCT/ZA2015/000046 dated Nov. 17, 2015, 10 pgs.

*Primary Examiner* — James S Bergin
(74) *Attorney, Agent, or Firm* — Merchant & Gould P.C.

(57) ABSTRACT

The invention provides a long range bullet. The bearing surface of the body of the bullet is provided with one or more annular narrows of which the combined length is at least one third of the length of the bearing surface of the bullet and which depth is between 0.005 mm up to half of the groove depth of a barrel in which the bullet is intended to shoot.

3 Claims, 12 Drawing Sheets

(51) Int. Cl.
*F42B 14/02* (2006.01)
*F42B 33/00* (2006.01)
*F42B 14/00* (2006.01)

(58) Field of Classification Search
USPC ..... 102/439, 524; 86/54, 55, 51
See application file for complete search history.

(56) References Cited

U.S. PATENT DOCUMENTS 847,149 A * 3/1907 Barlow ..... F42B 14/02 102/524
996,820 A * 7/1911 Wray ..... F42B 14/02 102/524
1,582,673 A * 4/1926 Fahrenwald ..... F42B 12/74 102/524
2,120,913 A * 6/1938 Studler ..... F42B 5/025 102/516
2,234,165 A * 3/1941 Hatcher ..... F42B 5/025 102/526
4,610,205 A * 9/1986 Bentley ..... F42B 14/02 102/501
5,058,503 A * 10/1991 Adams, III ..... F42B 10/42 102/439
5,463,960 A * 11/1995 Lowry ..... F42B 10/44 102/501
5,686,693 A * 11/1997 Jakobsson ..... F42B 12/72 102/501
D456,480 S * 4/2002 Quinsa ..... 102/508
6,439,125 B1 * 8/2002 Carter ..... F42B 5/025 102/507
7,210,411 B2 * 5/2007 Booth ..... F42B 12/74 102/514
7,302,891 B1 * 12/2007 Adams ..... F42B 5/025 102/439
8,857,343 B2 * 10/2014 Marx ..... F42B 12/78 102/517
8,893,621 B1 * 11/2014 Escobar ..... F42B 10/44 102/501
10,502,536 B2 * 12/2019 Mahnke ..... F42B 10/26
10,578,410 B2 * 3/2020 Mahnke ..... F42B 12/06
2006/0144280 A1 7/2006 Hirt et al.

FOREIGN PATENT DOCUMENTS

WO 84/02183 A1 6/1984
WO 2013/086544 A2 6/2013

* cited by examiner

PRIOR ART

LONG RANGE BULLET

This application is a National Stage Application of PCT/ZA2015/000046, filed 24 Jun. 2015, which claims benefit of Serial No. 2014/04618, filed 24 Jun. 2014 in South Africa and which applications are incorporated herein by reference. To the extent appropriate, a claim of priority is made to each of the above disclosed applications.

TECHNICAL FIELD OF THE INVENTION

This invention relates to a bullet for supersonic long range or flat trajectory shooting.

This invention also relates to mono metal bullets and bullets with a metal construction with control of in barrel friction and pressure whilst maintaining optimum aerodynamic properties of the bearing surface.

BACKGROUND TO THE INVENTION

Long range bullets are designed to provide a flat trajectory and stable flight over long distances. To achieve a flat trajectory the nose, bearing surface and boat tail needs to be aerodynamically optimized.

Typically long range bullets have a spitzer or small meplat point, boat tail and a relatively long curved/ogive nose and a smooth body. The bullets normally have an ogive part (i), cylinder part (ii) (bore bearing part) and the frustum part (iii) of the boat tail, see FIG. 8. The surface of the cylinder part bears against the bore of the barrel when fired and also fits in the neck of a cartridge/case. Long range boat tail bullets are typically used on targets at 200 m and beyond. Flat base bullets are used for high accuracy over shorter distances, normally for distances less than 300 m.

The inventor is aware of, from an internal ballistics point of view, the requirement for a good seal between the bullet and the bore of the barrel and engagement with the rifling of the barrel. However, this requirement causes friction and drag in the barrel as the bullet accelerates through the bore of the barrel, which, if excessive, causes high chamber pressures. The chamber pressure is at its peak shortly after ignition of the propellant. If the peak pressure is too high, it can cause a catastrophic explosion. There is a need for mono metal bullets which provide the required seal and rifling engagement with the minimum required in-barrel friction enabling controlled chamber pressures and increased muzzle velocity. This can be accomplished by designing a mono metal bullet with less bearing/contact surface against the inside of the barrel such as can be achieved by a set of circular rings provided about the bearing surface of a bullet. The rings or grooves are typically used as cannelure rings such as the rings described in PCT/ZA2012/000093. These rings or grooves are dimensioned to the bore diameter 1 of a barrel, while the cylinder diameter is dimensioned to the groove diameter 2. See FIGS. 8 and 9. The groove depth is shown by 3. The main problem with such rings or grooves is that they increase the aerodynamic drag and therefore lower the ballistic coefficient/aerodynamic performance of a bullet. The groove shape on the bearing surface of mono metal bullets is traditionally not aerodynamically optimized. The main purpose of grooves is to control in-barrel friction and pressure build up whilst ignoring the detrimental aerodynamic effect during free flight of the bullet. It can be shown that the typical drag of a groove will be significantly decreased by adjusting the leading and trailing edge angles of the groove to create weak shock waves instead of strong shock waves during supersonic flight.

In addition, use of any other material harder than pure copper such as brass, can also cause over pressure in the chamber when fired and it is a further object to be able to reduce the chamber pressure for all such bullets without the need to use grooves with detrimental aerodynamic effects.

It is an object of the invention to provide an extended range mono metal bullet with controlled friction within the barrel whilst maintaining a good seal with the groove diameter and without the aerodynamic sacrifice of grooves on the bullet.

GENERAL DESCRIPTION OF THE INVENTION

According to the invention there is provided a bullet of which the bearing surface of the body is provided with one or more annular narrows of which the combined length is at least one third of the length of the bearing surface of the bullet and which depth is between 0.005 mm up to half of the groove depth of a barrel in which the bullet is intended to shoot. See FIG. 10 where the depth of the narrow is given by 2 minus 4.

Each narrow may preferably be between 0.005 and 0.025 mm deep. Preferred depths are about 0.015 mm or about 15% of barrel groove depth. See FIG. 9. Generally this invention will reference bullets of 30 calibre (7.62 mm) for ease of description. All sizes and relations that are provided in this context will only be for reference purposes and is not be limiting the invention. In addition, it should be appreciated that the diameter dimensions of the features shown in the illustrative drawings are in most cases exaggerated.

Each narrow may preferably have a concave profile and gives the cylinder part of the bullet a slight hourglass shape in the case of a single narrow. The concave profile may be circular, segmented or may have a complex contour, preferably designed to give a uniform relief and aerodynamically beneficial throat on the bullet as discussed below. It will be appreciated that, in an extreme embodiment, the profile of the narrow may be a square angled groove of a finite depth such that it provides substantial aerodynamic benefit compared to for example a traditional bore diameter square bullet groove for mono metal bullets.

The invention provides one or more aerodynamically optimised narrows on the bearing surface of the bullet. A single narrow or double sloped recess may preferably be fully situated inside the neck part of the cartridge/case or it may be partially out or fully outside the neck of the case. There may be more than one narrow in the bullet such that at least two groove diameter parts of the bullet are located inside a case neck. It will be appreciated that two groove diameter parts of the bullet inside a case neck will promote concentricity of the bullet and will increase the holding strength of a case neck on the bullet.

When a stationary bullet, see FIG. 11 experiences the rapid build-up of pressure 5 behind it, it is forced forward with extreme force 6 as a result of the exploding propellant. This continuous push and acceleration force, at the base of the bullet result in a "bulging effect" with an increased friction surface 7 and volume 8 of material. It will be appreciated that the harder the material the more the friction, hence the problem of over pressure when using brass, for example. In the case of a bullet provided with a narrow, in accordance with the invention, instead of a "bulging effect" the pressure causes a "flattening effect" only, with less friction.

According to a method for this invention only the very small amount of material that makes up the "volume of friction pressure material" needs to be removed from the bearing surface of the bullet to facilitate control over bullet acceleration and/or pressure build up behind the bullet.

It will be appreciated that sufficient friction and gas sealing needs to be maintained for a bullet to accelerate in a controlled manner and to stay inside the barrel for a sufficiently long time to absorb the maximum energy of the exploding propellant. Therefore there is a minimum required "touching bearing surface" such that it will properly align the bullet inside the barrel. For this invention these touching surfaces will normally be found on the extremities of the bearing surface. The touching bearing surfaces appears to work well even if it is only 10% of the length of the bearing surface.

It is also to be appreciated that the narrow length and depth can be shaped to control chamber pressures. Ideally the narrow is the removal of material that compress against the groove diameter surface as a result of the temporary fattening effect on the bullet that is most profound at shot start.

It will be appreciated that the longer the length of the narrow and the more spaced apart the bands are on the extremities of the bearing surface, less bearing will surface remain, which may lead to initial instability/misalignment of the bullet in the chamber and bore of the barrel. However, the inventor did not find any signs of such initial instability and it is believed the initial stability and stability through the barrel is as a result of pushing up of the narrow due to bullet compression to a point where it may or may not make contact with the bore as a result of the pressure at the back of the bullet. The embodiment shown in FIG. 12 can counter such possible instability/misalignment of the bullet in the chamber and bore of the barrel. The "bulging or flattening effect" on the bullet is appreciably more pronounced when the pressure and acceleration is peaking during shot start. Pressure behind the bullet decreases progressively as the movement and velocity of the bullet increases inside the barrel with the annular narrow gradually returning to its original shape and further decreasing the friction in the barrel. It will be appreciated that shot start friction is reduced but the length of the bearing surface is mostly maintained and as the bullet travels through the barrel friction is further reduced as the temporary deformation the narrow gradually return back to normal. It will also be appreciated that the invention may allow use of a variation in the selected speed of burning powders to compensate for the shorter time spent by the bullet in the barrel.

The dimensions of the spaced apart bearing surfaces and the narrow allow the cartridge/case neck to adequately support the bullet for normal handling.

It will further be appreciated that an annular narrow with a shallow smooth concave profile has almost no lowering effect on the ballistics coefficient.

DETAILED DESCRIPTION OF THE INVENTION

The invention also has reference to flat base bullets. The trajectory of flat based bullets can also be similarly improved by employing the "narrow" or the "recess" for such a bullet.

The invention is now described by way of example with reference to the further accompanying drawings.

Figure 1:
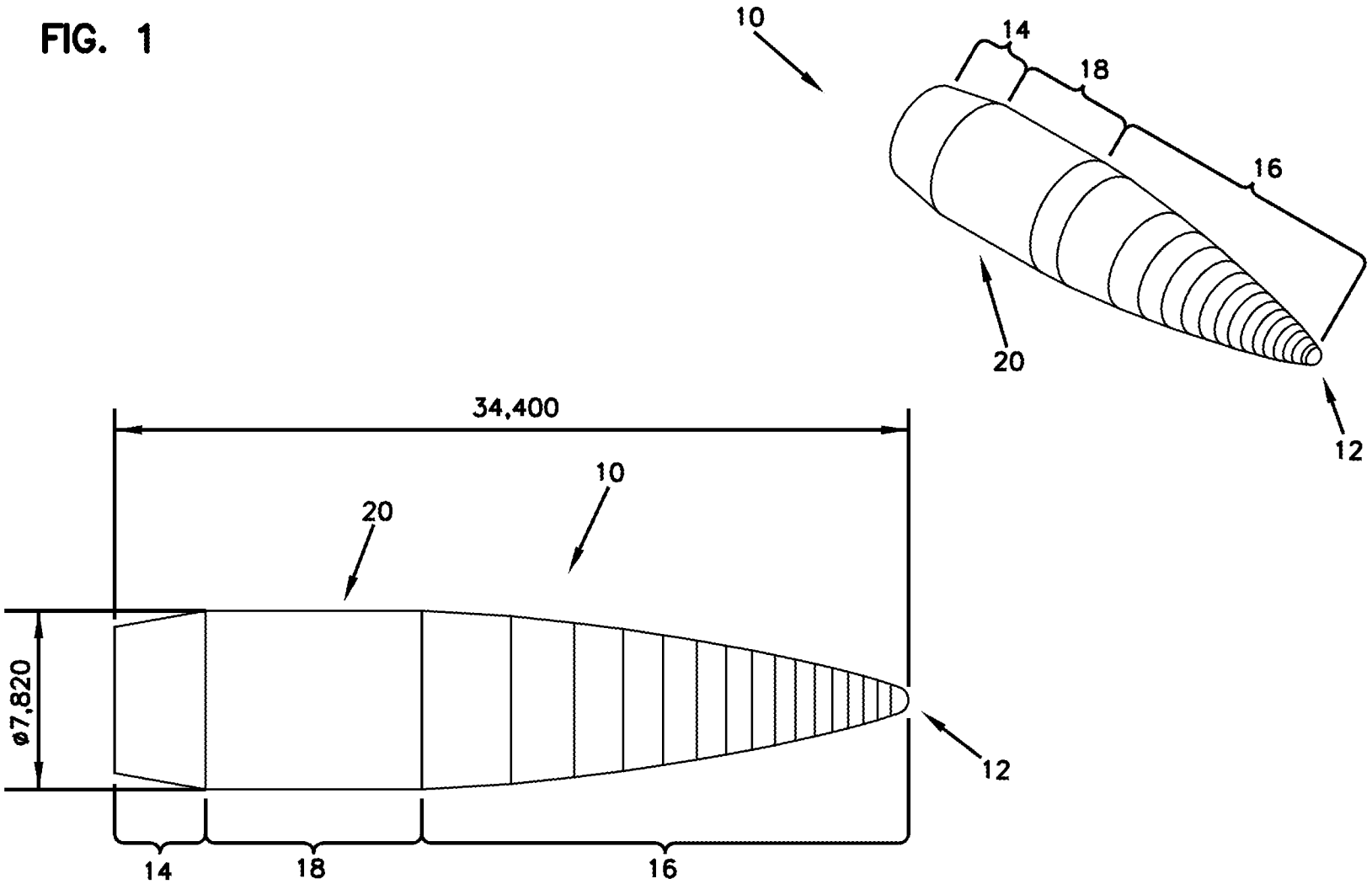
FIG. 1 shows a profile and perspective view of one embodiment of a long range bullet, in accordance with the invention.

Referring now to the drawings, the bullet, in accordance with the invention, is generally indicated by reference numeral 10.

In the shown embodiments, each of the copper bullets 10 has a spitzer point 12, a boat tail 14, a secant ogive 16 and cylinder part 18 or bore bearing part.

Figure 2:
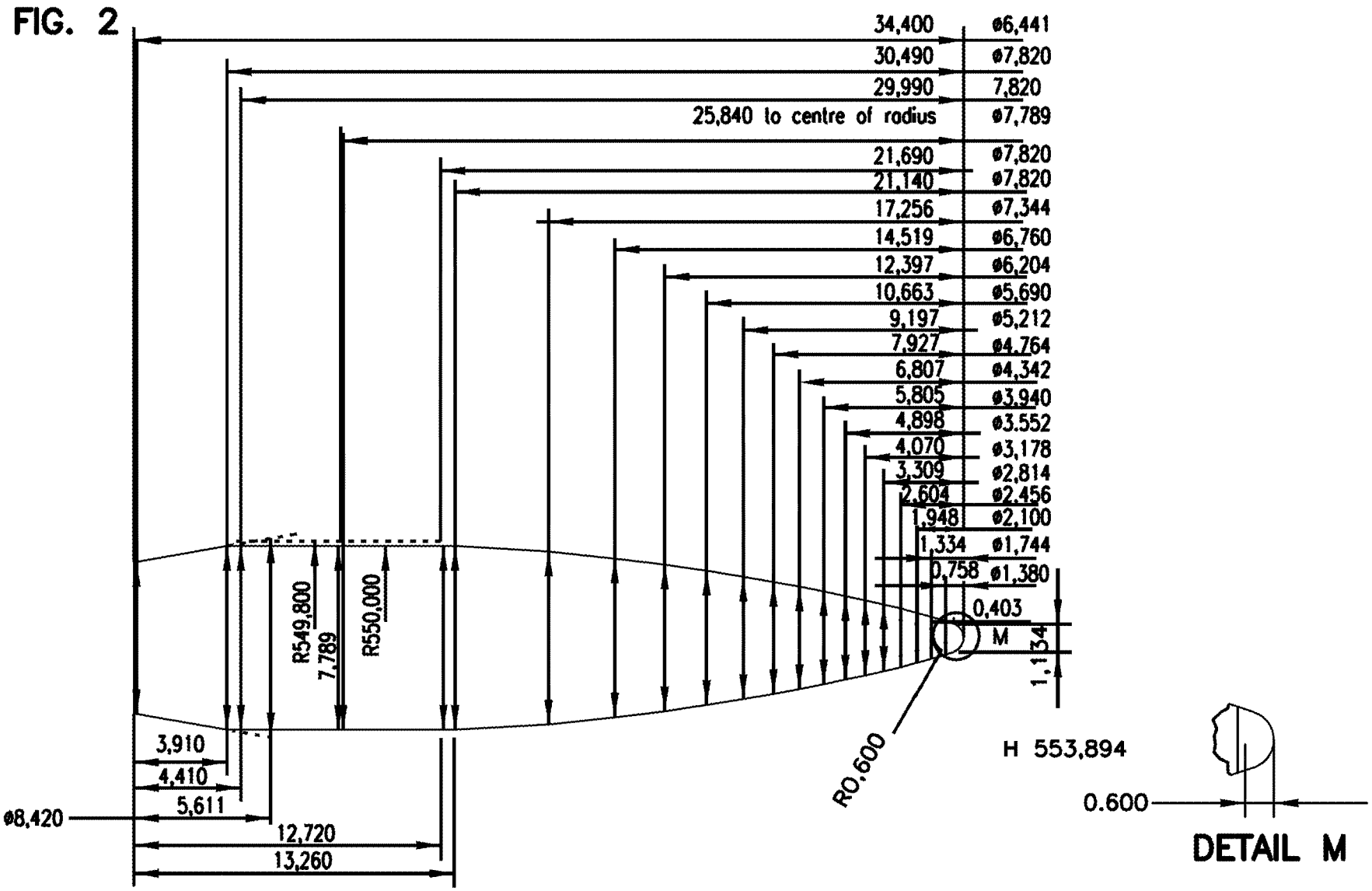
FIG. 2 shows dimensions of the bullet shown in FIG. 1.

FIGS. 1 and 2 shows a bullet 10 of which the cylinder part 18 of the body is provided with a single smooth concave annular narrow 20 of 7.099 mm length with a bearing surface length of 1.751 mm remaining of the cylinder 10. The depth of the narrow is 0.0155 mm along its middle.

Figure 3:
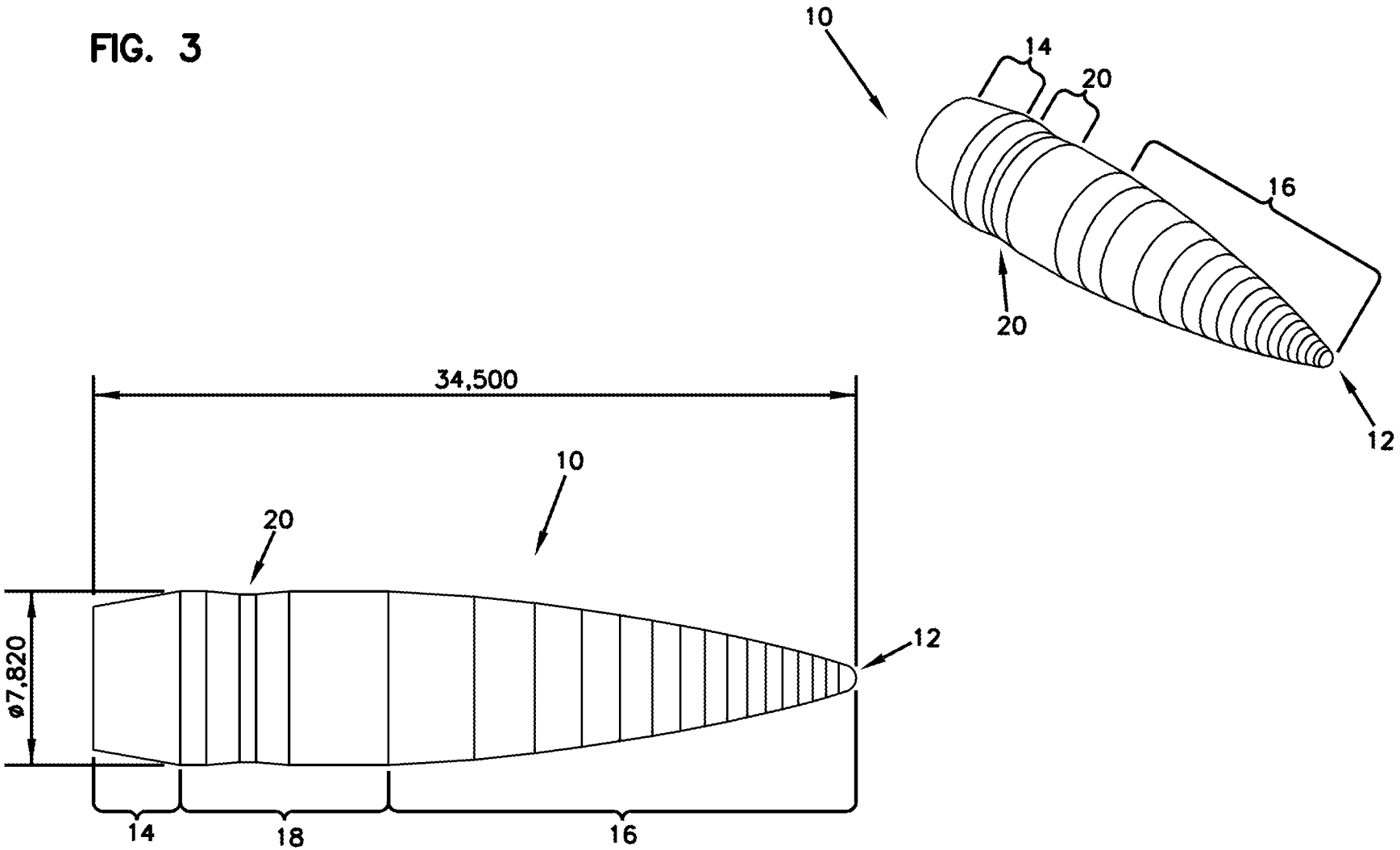
FIG. 3 shows a profile and perspective view of another embodiment of a long range bullet, in accordance with the invention.
Figure 4:
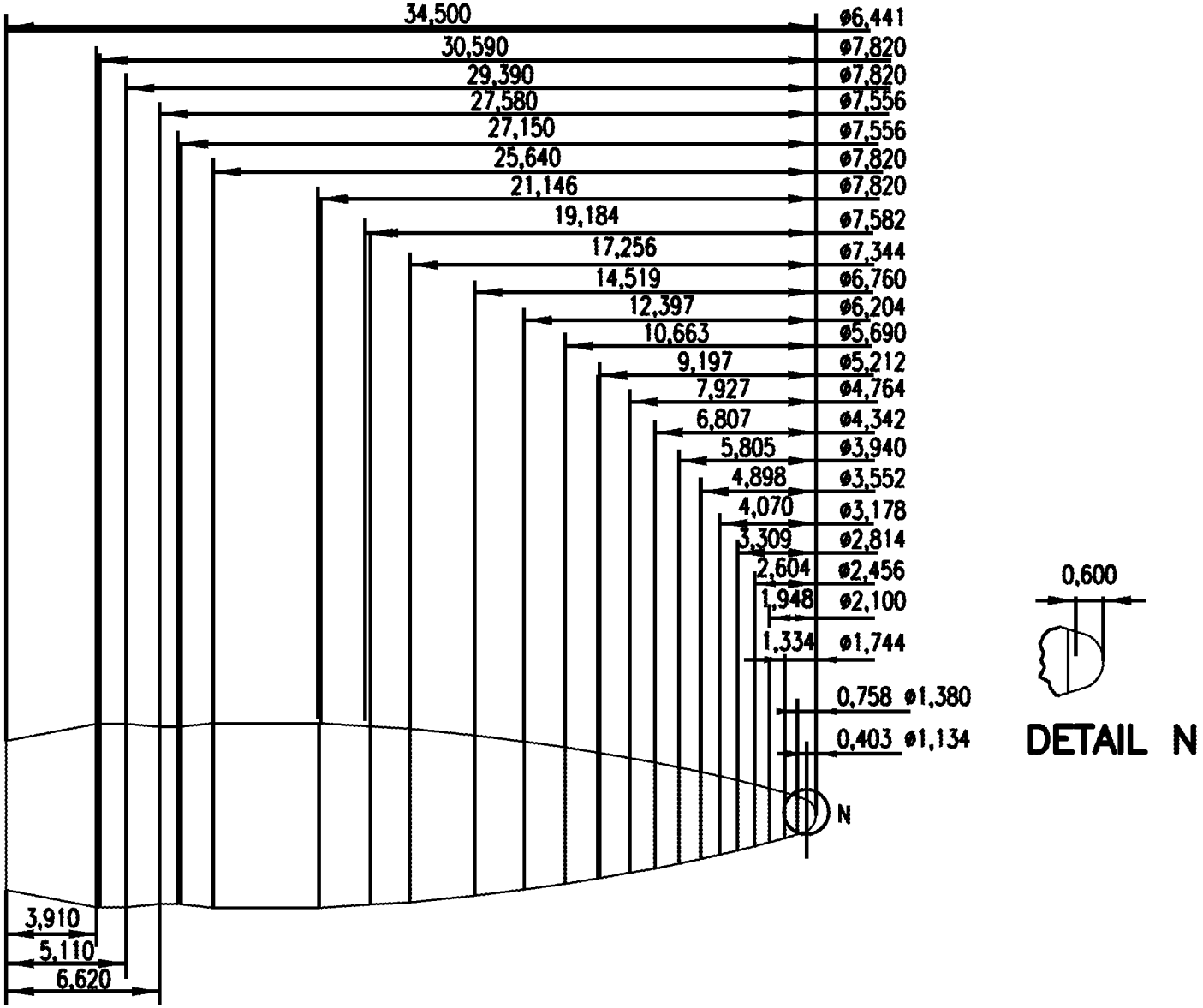
FIG. 4 shows dimensions of the bullet shown in FIG. 3.

FIGS. 3 and 4 shows a bullet 10 of which the cylinder part 18 of the body is provided with a single angled annular narrow 20 of 3.750 mm length with a bearing surface length of 5.700 mm remaining of the cylinder 10. The depth of the narrow is 0.264 mm along its middle.

Figure 5:
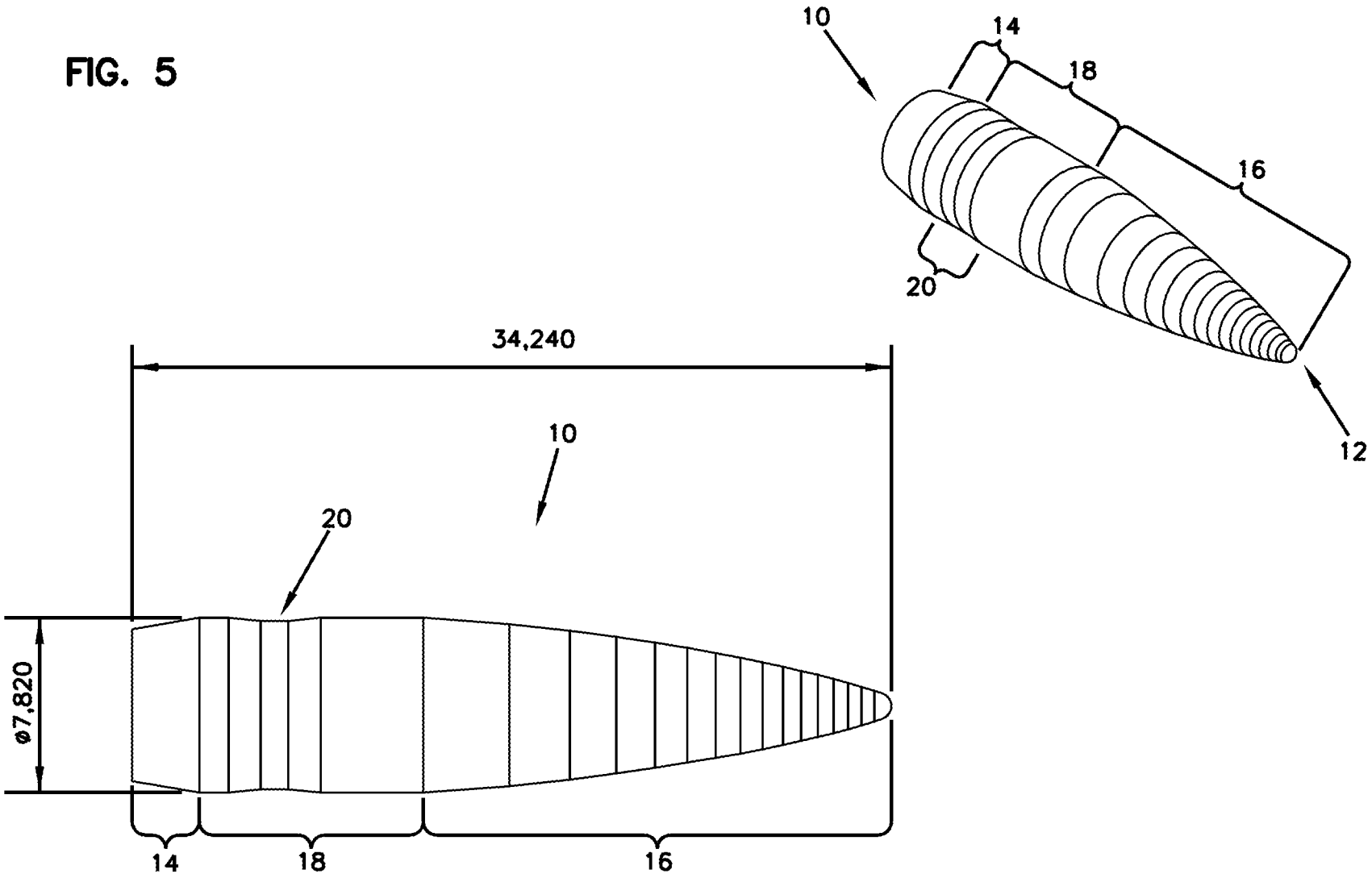
FIG. 5 shows a profile and perspective view of another embodiment of a long range bullet, in accordance with the invention.
Figure 6:
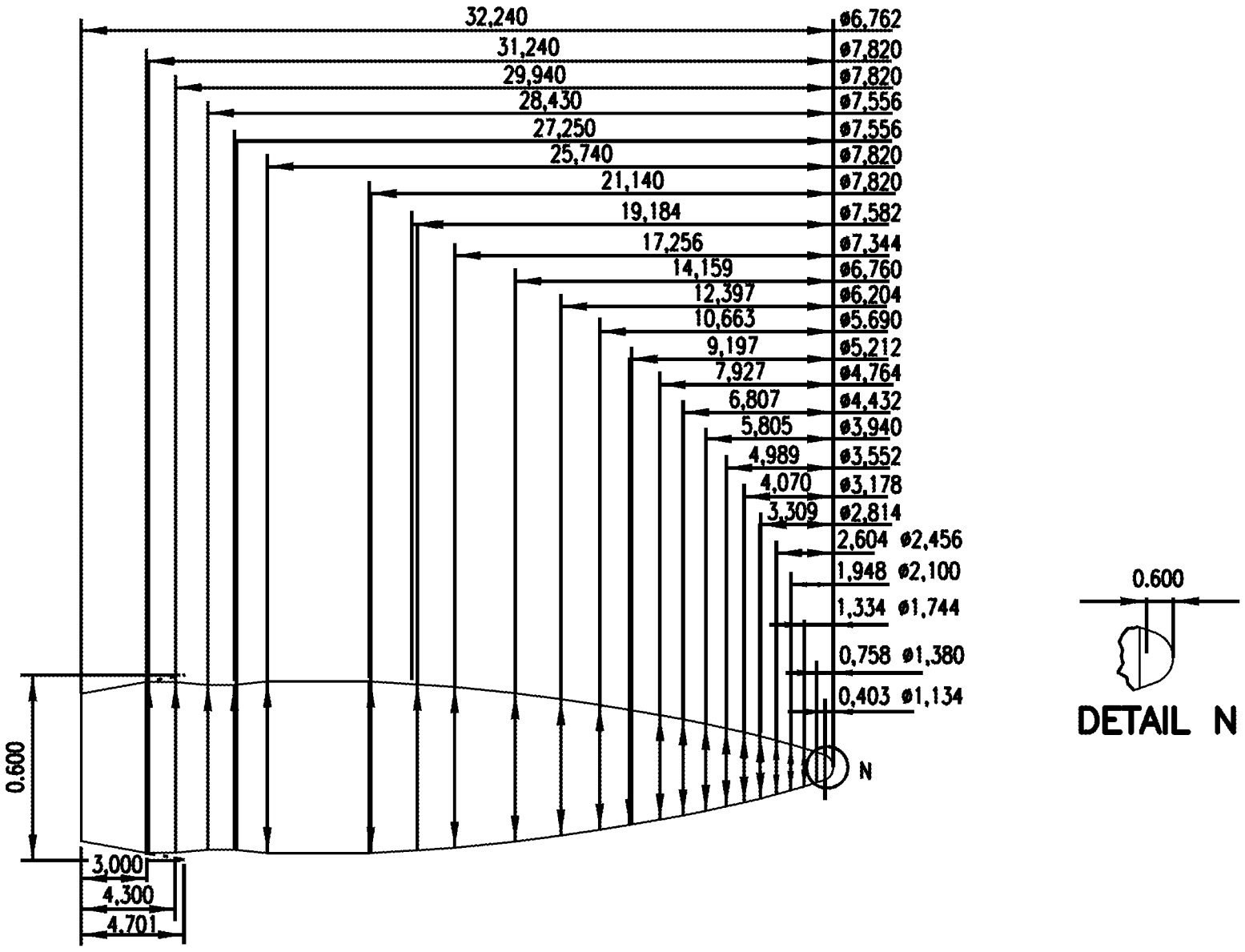
FIG. 6 shows dimensions of the bullet shown in FIG. 5.

FIGS. 5 and 6 shows a similar bullet 10 of which the cylinder part 18 of the body is provided with a single angled annular narrow 20 of 4.200 mm length with a bearing surface length of 5.900 mm remaining of the cylinder 10. The depth of the narrow is 0.264 mm along its middle.

Figure 7:
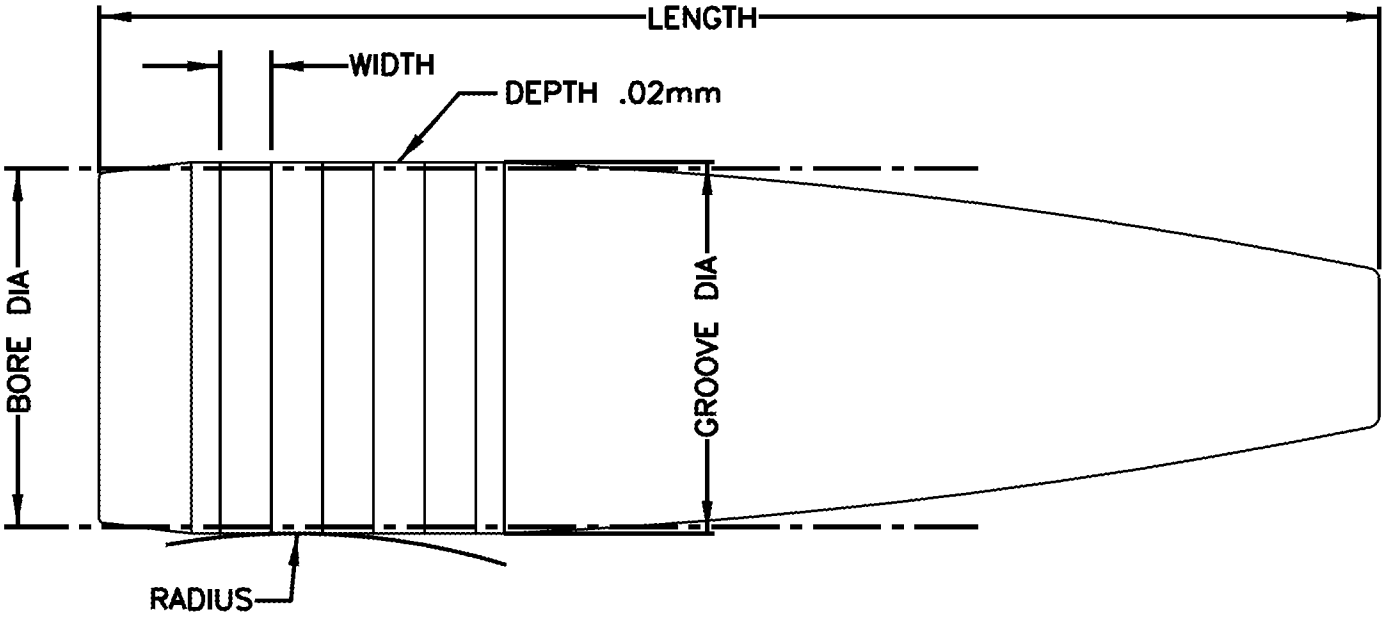
FIG. 7 shows a bullet having multiple narrows, each having a depth of 0.02 mm below the groove diameter.
Figure 8:
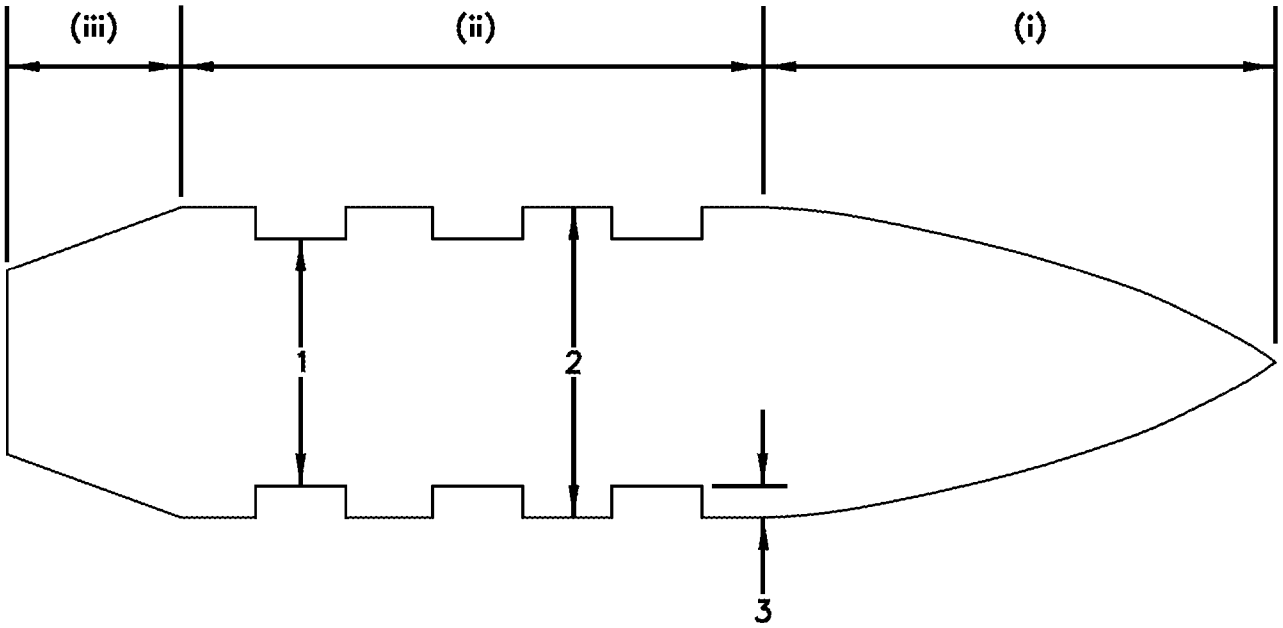
FIG. 8 PRIOR ART
FIG. 8 shows an example long range bullet
Figure 9:
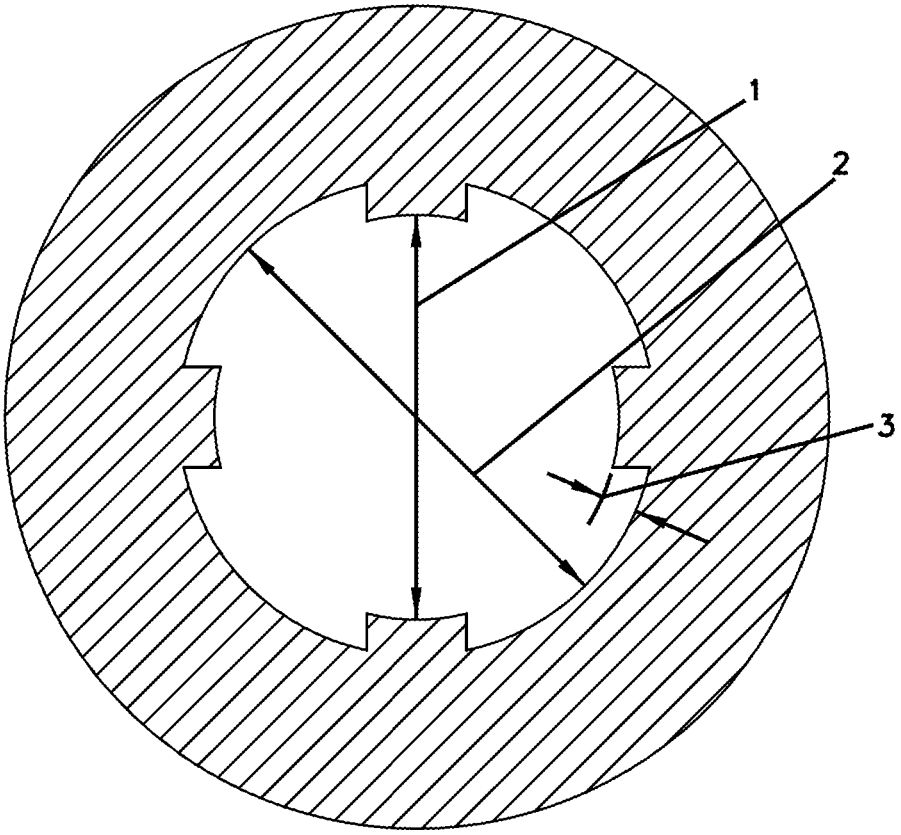
FIG. 9 is a cross sectional view of a barrel.
Figure 10:
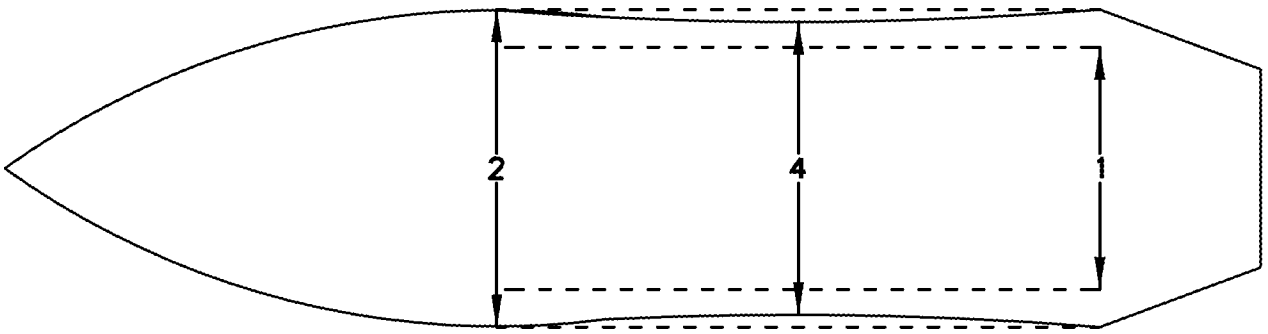
FIG. 10 shows a bullet having a bearing surface with one or more annular narrows.
Figure 11:
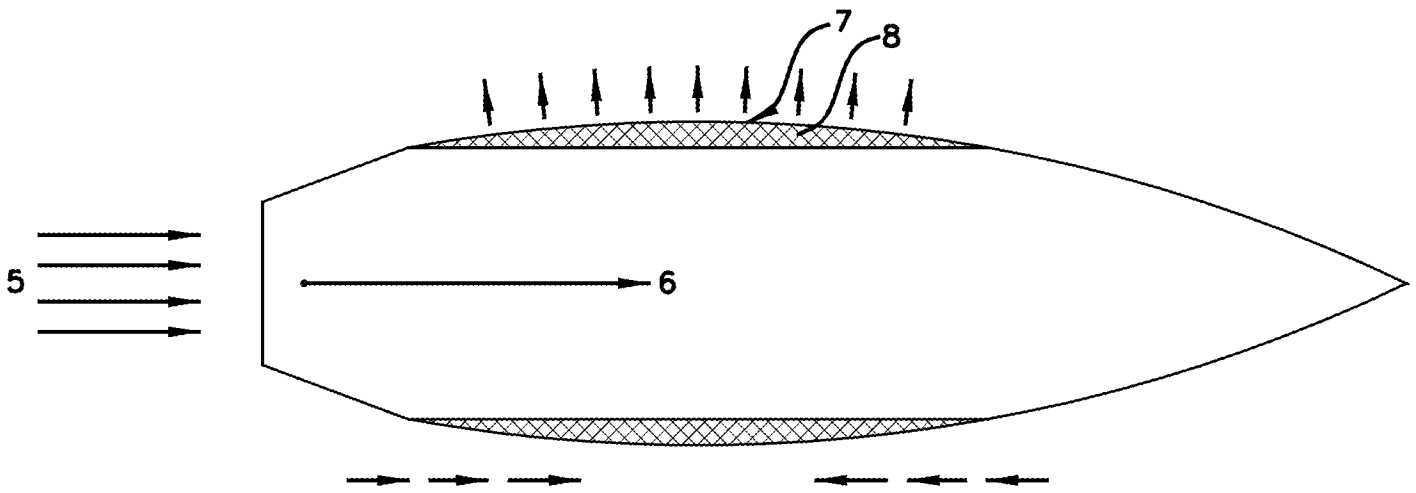
FIG. 11 illustrates a bullet experiencing a pressure build-up.
Figure 12:
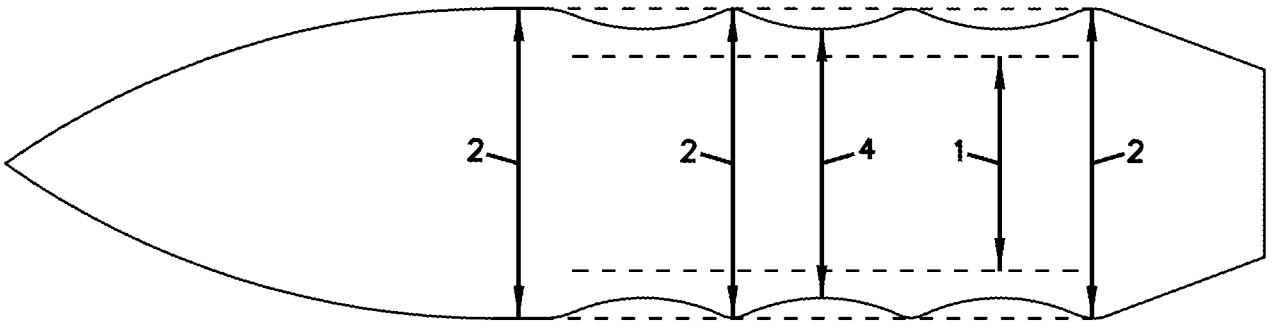
FIG. 12 shows another example bullet.

FIG. 7 shows a bullet having multiple narrows, each having a depth of 0.02 mm below the groove diameter. The profile of one of the narrows is indicated by the radius of a circle defining the profile.

It shall be understood that the examples are provided for illustrating the invention further and to assist a person skilled in the art with understanding the invention and are not meant to be construed as unduly limiting the reasonable scope of the invention.

The invention claimed is:

1. A bullet configured to be attached to a cartridge and fired through a barrel, the cartridge having a case neck, and the barrel having a groove, the groove having a groove depth, the bullet comprising:

a body;

a bearing surface on the body; and a single annular narrow on the bearing surface and having a length and a depth, the length being at least one third of a length of the bearing surface of the bullet, and the depth being between 0.005 to 0.025 mm, wherein the depth is sized to correspond to up to half of the groove depth of the barrel through which the bullet is intended to be fired.

2. The bullet as claimed in claim 1, wherein the narrow has a concave profile.

3. The bullet as claimed in claim 1, wherein the bearing surface has a smooth longitudinal profile, and whereby cannelure rings are not required.

* * * * *